US010610754B2

(12) United States Patent
Hofmann et al.

(10) Patent No.: US 10,610,754 B2
(45) Date of Patent: Apr. 7, 2020

(54) AQUATIC GAME APPARATUS AND METHOD OF PLAYING AQUATIC GAME

(71) Applicants: Colleen Marie Hofmann, Newburgh, IN (US); Mark Adam Hofmann, Newburgh, IN (US)

(72) Inventors: Colleen Marie Hofmann, Newburgh, IN (US); Mark Adam Hofmann, Newburgh, IN (US)

( * ) Notice: Subject to any disclaimer, the term of this patent is extended or adjusted under 35 U.S.C. 154(b) by 192 days.

(21) Appl. No.: 15/649,442

(22) Filed: Jul. 13, 2017

(65) Prior Publication Data

US 2018/0028887 A1 Feb. 1, 2018

Related U.S. Application Data

(60) Provisional application No. 62/367,543, filed on Jul. 27, 2016.

(51) Int. Cl.

| | |
|---|---|
| ***A63B 67/00*** | (2006.01) |
| ***A63F 9/00*** | (2006.01) |
| ***A63F 9/06*** | (2006.01) |
| *A63B 71/06* | (2006.01) |
| *A63B 71/00* | (2006.01) |

(52) U.S. Cl.

CPC ..... *A63B 67/007* (2013.01); *A63F 9/0073* (2013.01); *A63F 9/0076* (2013.01); *A63F 9/0604* (2013.01); *A63F 9/0666* (2013.01); *A63B 71/0054* (2013.01); *A63B 2071/0694* (2013.01); *A63B 2208/03* (2013.01); *A63B 2208/12* (2013.01); *A63B 2225/60* (2013.01); *A63F 2250/205* (2013.01)

(58) Field of Classification Search

CPC ..... A63B 67/007
USPC ..... 273/273
See application file for complete search history.

(56) References Cited

U.S. PATENT DOCUMENTS

| | | | | | |
|---|---|---|---|---|---|
| 1,499,628 | A | * | 7/1924 | Alger | A63H 23/10 273/108 |
| 2,207,864 | A | * | 7/1940 | Hoeltje | A63B 67/007 273/350 |
| 3,014,723 | A | * | 12/1961 | Butler | A63B 67/007 273/350 |
| 3,403,907 | A | * | 10/1968 | Keller | A63F 9/0243 273/350 |
| 3,544,113 | A | | 12/1970 | Hand | |
| 3,586,323 | A | * | 6/1971 | Carter | A63B 67/007 273/440 |

(Continued)

*Primary Examiner* — John E Simms, Jr.
*Assistant Examiner* — Dolores R Collins
(74) *Attorney, Agent, or Firm* — Taft Stettinius & Hollister LLP

(57) ABSTRACT

An apparatus for shape and color matching retrieval games to be played in a body of water, such as a swimming pool, includes base stations, cover panels, and retrieval objects that players retrieve from the body of water during play of the game. The base provides a support to which cover panels can be removably affixed. The base and the cover panels each have on their top surfaces a series of position markers in the nature of slots formed in various geometric shapes. Each base and cover panel has a subset of retrieval objects matched in shape and/or color to its respective position markers. A method is provided for playing different versions of retrieval games using the base and the cover panels.

5 Claims, 13 Drawing Sheets

(56) References Cited

U.S. PATENT DOCUMENTS

| | | | | | |
|---|---|---|---|---|---|
| 3,703,011 | A * | 11/1972 | Goggi | A63B 67/007 | 114/346 |
| 3,806,156 | A * | 4/1974 | Tidwell | A63B 19/02 | 280/206 |
| 3,853,317 | A * | 12/1974 | Braunhut | A63F 7/0608 | 119/253 |
| 4,307,887 | A * | 12/1981 | Weiss | A63B 67/007 | 472/128 |
| 5,281,144 | A | 1/1994 | Pease | | |
| 5,810,364 | A * | 9/1998 | Canion | A63B 67/007 | 273/440 |
| 6,482,097 | B1 * | 11/2002 | Fireman | A63B 67/007 | 273/140 |
| 6,913,505 | B1 * | 7/2005 | Chiang | A63F 23/10 | 273/350 |
| 7,017,911 | B1 | 3/2006 | Chia | | |
| 7,029,400 | B2 | 4/2006 | Briggs | | |
| 7,101,248 | B2 * | 9/2006 | Chiang | A63H 23/08 | 441/23 |
| 7,278,637 | B2 | 10/2007 | Huebl et al. | | |
| 8,857,817 | B2 * | 10/2014 | Cruz-Rivera | A63F 3/00176 | 273/261 |
| 2012/0100775 | A1 * | 4/2012 | Marciano | A63H 23/00 | 446/153 |
| 2014/0148077 | A1 | 5/2014 | Hunter | | |
| 2014/0268663 | A1 * | 9/2014 | Yang | F21S 10/002 | 362/101 |
| 2015/0209661 | A1 * | 7/2015 | Klemm | A63F 9/10 | 273/157 R |

* cited by examiner

| LIST OF GAME PIECES<br>LEVEL I GAME | |
|---|---|
| FIRST BASE (REFERENCE NUMERAL 1, FIG. 1): | |
| ZONE<br>(REFERENCE NUMERAL): | COLOR OF ZONE AND<br>MATCHING OBJECTS: |
| PLAYER 1 (8) | LIGHT BLUE |
| PLAYER 2 (9) | BRIGHT BLUE |
| PLAYER 3 (10) | KELLY GREEN |
| | |
| SECOND BASE (REFERENCE NUMERAL 11, FIG. 6): | |
| ZONE<br>(REFERENCE NUMERAL): | COLOR OF ZONE AND<br>MATCHING OBJECTS: |
| PLAYER 4 (12) | RED |
| PLAYER 5 (13) | YELLOW |
| PLAYER 6 (14) | LAVENDER |

FIG. 7

| LIST OF GAME PIECES<br>LEVEL II GAME | |
|---|---|
| FOR SIX PLAYERS:<br>A FIRST BASE 1 FITTED WITH A FIRST LEVEL II COVER PANEL 15<br>A SECOND BASE 11 FITED WITH A SECOND LEVEL II COVER PANEL 15<br><br>OBJECTS FOR EACH ONE OF THE SIX PLAYER ZONES<br>IN THE TWO COVER PANELS 15, 15: | |
| SHAPE OF SLOT AND OBJECT: | COLOR OF OBJECT: |
| OCTAGON | RED |
| PENTAGON | BRIGHT BLUE |
| CIRCLE | LIGHT BLUE |
| RECTANGLE | DARK BLUE |
| PARALLELOGRAM | PERIWINKLE |
| HENDECAGON | TURQUOISE |
| TRIANGLE | KELLY GREEN |
| HEXAGON | YELLOW |
| RHOMBUS | LAVENDER |
| TRAPEZOID | DARK GREEN |

FIG. 10

| LIST OF GAME PIECES<br>LEVEL III GAME FOR PLAYERS ONE THROUGH THREE | |
|---|---|
| A FIRST BASE 1 FITTED WITH A<br>FIRST LEVEL III COVER PANEL 19<br>OBJECTS FOR EACH ONE OF THE PLAYER ZONES IN<br>THE FIRST LEVEL III COVER PANEL 19: | |
| SHAPE OF SLOT<br>AND OBJECT: | COLOR OF SLOT<br>AND OBJECT: |
| PLAYER 1 ZONE (REFERENCE NUMERAL 20): | |
| HEXAGON | DARK GREEN |
| TRIANGLE | KELLY GREEN |
| PARALLELOGRAM | ORANGE |
| OCTAGON | LIGHT BLUE |
| CIRCLE | ORANGE |
| TRAPEZOID | BRIGHT YELLOW |
| RHOMBUS | TURQUOISE |
| PENTAGON | LAVENDER |
| HENDECAGON | RED |
| RECTANGLE | PINK |
| PLAYER 2 ZONE (REFERENCE NUMERAL 21): | |
| PENTAGON | YELLOW |
| PARALLELOGRAM | PINK |
| RECTANGLE | LIGHT BLUE |
| TRAPEZOID | DARK GREEN |
| OCTAGON | ORANGE |
| HEXAGON | YELLOW |
| TRIANGLE | ORANGE |
| RHOMBUS | RED |
| HENDECAGON | KELLY GREEN |
| CIRCLE | DARK BLUE |
| PLAYER 3 ZONE (REFERENCE NUMERAL 22): | |
| OCTAGON | RED |
| HEXAGON | KELLY GREEN |
| HENDECAGON | TURQUOISE |
| PARALLELOGRAM | YELLOW |
| TRIANGLE | PINK |
| CIRCLE | LIGHT BLUE |
| TRAPEZOID | LAVENDER |
| RHOMBUS | DARK BLUE |
| RECTANGLE | NEON GREEN |
| PENTAGON | ORANGE |

FIG. 12

| LIST OF GAME PIECES<br>LEVEL III GAME FOR PLAYERS FOUR THROUGH SIX | |
|---|---|
| A SECOND BASE 11 FITTED WITH A SECOND LEVEL III COVER PANEL 23<br>OBJECTS FOR EACH ONE OF THE PLAYER ZONES IN THE SECOND LEVEL III COVER PANEL 23: | |
| SHAPE OF SLOT AND OBJECT: | COLOR OF SLOT AND OBJECT: |
| PLAYER 4 ZONE (REFERENCE NUMERAL 24): | |
| TRIANGLE | LAVENDER |
| CIRCLE | PINK |
| PENTAGON | LIGHT BLUE |
| RECTANGLE | RED |
| PARALLELOGRAM | BRIGHT BLUE |
| TRAPEZOID | TURQUOISE |
| HENDECAGON | YELLOW |
| RHOMBUS | YELLOW |
| HEXAGON | ORANGE |
| OCTAGON | PINK |
| PLAYER 5 ZONE (REFERENCE NUMERAL 25): | |
| RECTANGLE | YELLOW |
| OCTAGON | NEON GREEN |
| HENDECAGON | ORANGE |
| PENTAGON | KELLY GREEN |
| RHOMBUS | PINK |
| HEXAGON | RED |
| TRIANGLE | TURQUOISE |
| CIRCLE | RED |
| TRAPEZOID | ORANGE |
| PARALLELOGRAM | LAVENDER |
| PLAYER 6 ZONE (REFERENCE NUMERAL 26): | |
| PARALLELOGRAM | LIGHT BLUE |
| RHOMBUS | ORANGE |
| HENDECAGON | DARK GREEN |
| PENTAGON | PINK |
| RECTANGLE | LAVENDER |
| OCTAGON | YELLOW |
| TRAPEZOID | BRIGHT BLUE |
| HEXAGON | TURQUOISE |
| CIRCLE | YELLOW |
| TRIANGLE | RED |

FIG. 14

AQUATIC GAME APPARATUS AND METHOD OF PLAYING AQUATIC GAME

CROSS-REFERENCE TO RELATED APPLICATIONS

This application claims priority under 35 U.S.C. § 119 to provisional application Ser. No. 62/367,543, filed Jul. 27, 2016, herein incorporated by reference in its entirety.

FIELD OF THE INVENTION

The present invention relates generally to games. In particular the invention relates to shape and color matching retrieval games to be played in a body of water such as a swimming pool.

BACKGROUND OF THE INVENTION

The present invention relates to a game, method and apparatus for playing the game providing improvements over prior art games in terms of offering educational benefits as well as swim exercise benefits during entertaining competitive play. A unique multi-game aspect allows use of a single set of game apparatus to play three different swimming games, each attuned to a different level of swimming ability and of ability of players to match colors, shapes, and words. Thus the game is adaptable to entertain and educate players of different age and education levels.

SUMMARY OF THE INVENTION

The apparatus for the game comprises base stations, cover panels, and retrieval objects. In a preferred embodiment, a base station is generally in the nature of a box-shaped base to which cover panels can be removably affixed. The base and the cover panels each have on their top surfaces a series of position markers in the nature of recesses, depressions, or slots formed in various geometric shapes. The base and its matching subset of retrieval objects are used for play of a first version of the game (Level I). Preferably, the apparatus includes a first cover panel and a matching subset of the retrieval objects for playing a second version of the game (Level II). Preferably the apparatus also includes a second cover panel with another matching subset of retrieval objects for playing a third version of the game (Level III). In this manner, the apparatus allows for a method of playing an educational and entertaining three-in-one game, with progressively more challenging swimming and matching tasks to engage, educate, and physically and mentally challenge the players.

BRIEF DESCRIPTION OF THE DRAWINGS

FIG. 7 is a chart showing a game piece listing for a Level I game according to the invention.

FIG. 10 is a chart showing a game piece listing for a Level II game according to the invention.

FIG. 12 is a chart showing a game piece listing for players one through three of a Level III game according to the invention.

FIG. 14 is a chart showing a game piece listing for players four through six of a Level III game according to the invention.

DETAILED DESCRIPTION OF THE PREFERRED EMBODIMENTS

The apparatus for the game comprises base stations, cover panels, and retrieval objects. In a preferred embodiment, a base station is generally in the nature of a box-shaped base to which cover panels can be removably affixed. The base and the cover panels each have on their top surfaces a series of position markers in the nature of recesses, depressions, or slots formed in various geometric shapes.

Figure 1:
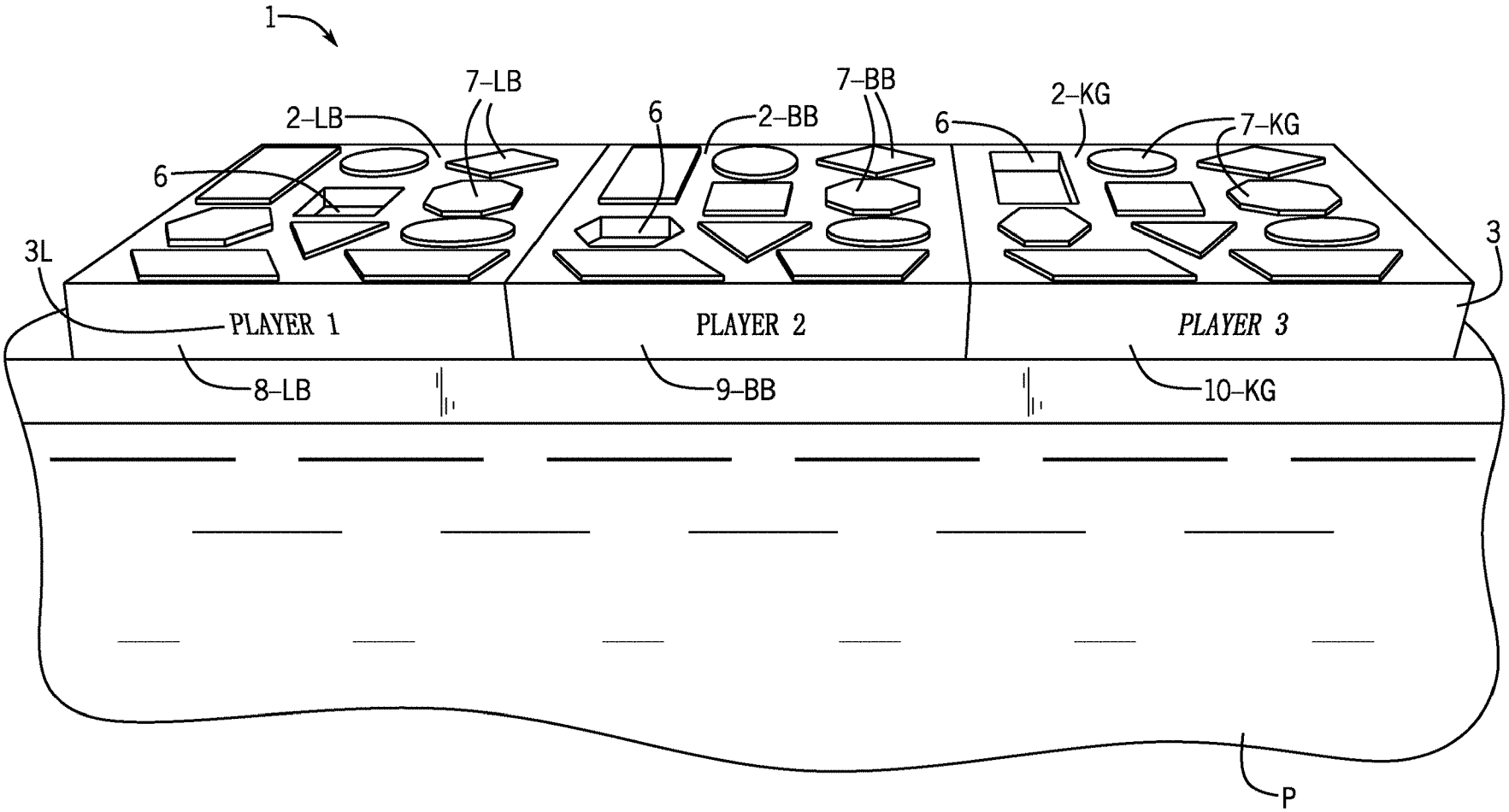
FIG. 1 is a front perspective view of a first base station according to the invention.

A representative embodiment of a base station is shown in FIG. 1. The base station is in the form of a box-shaped base 1. The base 1 is in the form of a portable box configured to be placed on the side of a body of water suitable for swimming, such as a swimming pool, lake, riverside, or beach area. The base 1 preferably has a top surface 2 and a front surface 3 positioned at angles allowing a top surface 2 of each base 1 and a front surface 3 of each base 1 to be viewed by a swimmer who is swimming or standing in the swimming pool, or other body of water, by which the base is positioned. The body of water is schematically represented as the side of the pool P in FIG. 1.

Figure 2:
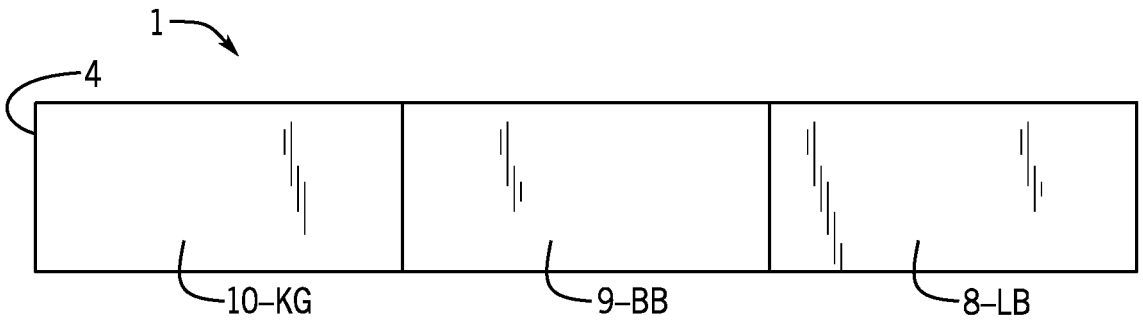
FIG. 2 is a rear view of the first base station of FIG. 1.
Figure 3:
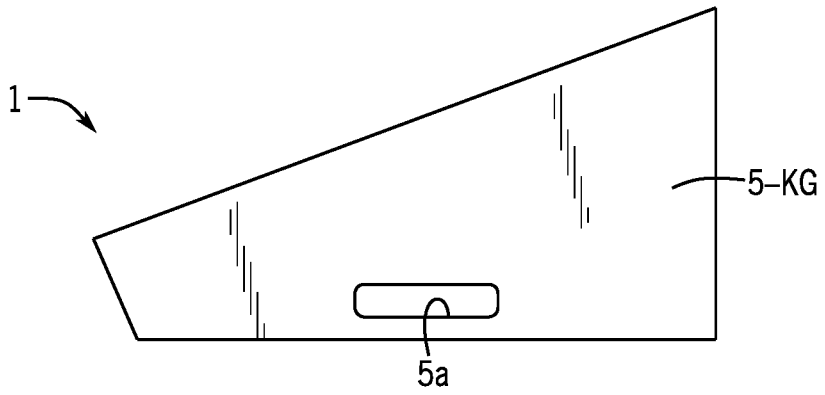
FIG. 3 is a right side view of the first base station of FIG. 1.

The base 1 has a rear surface 4 shown in FIG. 2. The base 1 may have a right trapezoidal shape in cross-section, as can be seen from the view of the right side surface 5 as shown in FIG. 3. The right trapezoidal shape allows the swimmer to view the top 2 and front 3 surfaces while swimming or standing in the pool P when the front surface 3 is positioned to abut an edge of the pool P. The slope of the top surface 2 allows water to drain toward the front side of the base, back into the pool P. The base 1 preferably has carrying means, such as an aperture 5*a* as shown in FIG. 3. The aperture 5*a* is an open portion of a side surface 5 of the base, open so as to form a handle into which a user can insert a hand to pick up and carry the base. Preferably there is such a handle formed on each one of the two side surfaces 5, 5.

The base may have a closed bottom surface, but preferably the base 1 is in the shape of a box with an open bottom side on the bottom plane on which it rests, the base 1 supported by the bottom edges of the front 3, rear 4, and side 5, 5 surfaces resting on the ground near the pool P. The base 1 with such an open bottom side may preferably be sized and shaped to have a slight incline in its front, rear, and/or side surfaces. This configuration has the upper edges of these surfaces tilted slightly inwardly from their respective lower edges, so that the top surface 2 of the base 1 is slightly smaller than the open bottom side of the base 1, to facilitate stacking of the bases 1, 1 on top of one another for compact storage.

The base 1, as well as the other game parts including the cover panels and retrieval objects described below, preferably is formed of a resilient thermoplastic material resistant to fading, cracking, mold formation, and degradation arising from exposure to sunlight, heat, swimming pool chemicals, and wet conditions. All parts preferably are formed of material that is sufficiently pliant to avoid injury to players who handle and bump into the parts during play. All parts preferably have smooth edges to avoid injury to players during play.

As seen in FIG. 1 and other figures, the base 1 has formed in or on its top surface 2 a plurality of position markers. In the example depicted in FIG. 1, the position markers are in the form of depressions or slots 6, 6, formed in various geometric shapes. The slots 6, 6 are shaped and adapted to accept insertion of retrieval objects 7, 7 described in more detail below. The retrieval objects 7, 7 are sized and shaped to fit within the slots 6 in a defined pattern. In an embodiment, the position markers may be formed as outlines of the respective geometric shapes, instead of depressions or slots as shown in FIG. 1.

I. Level I Game.

FIG. 1 shows an embodiment of the base 1 for playing a first one of the multiple games that may be played using the game apparatus. The first game is referred to herein as the Level I game.

FIG. 1 shows a preferred embodiment of the base 1 for play of the Level I game, having a defined pattern of position markers in the form of depressed surface portions like recesses or slots 6, 6, formed in the top surface 2 of the base 1 to receive inserting of the corresponding retrieval objects 7, 7 for play of the Level I game. In the Level I game, the base 1 is divided into a plurality of zones, with each zone marked and defined by having a different zone color. For example, as shown in the Level I game of FIG. 1, the base 1 may preferably be divided into three play zones, represented in FIG. 1 by reference numerals 8, 9, and 10, respectively. Each one of the three zones 8, 9, and 10 is the play zone for players 1, 2 and 3, respectively. In the example shown, each one of the three zones is marked with a label 3L positioned on the front side 3 of the base 1 to show a player number assigned to the player of that zone, namely the label 3L "Player 1" in zone 8, the label 3L "Player 2" in zone 9, and a label 3L "Player 3" in zone 10. Each of the zones 8, 9, and 10, respectively has a different zone color. In the example shown in FIG. 1, zone 8 is light blue ("LB" in the reference numerals specifies a light blue color of the item), zone 9 is bright blue ("BB" in reference numerals specifies bright blue color), and zone 10 is kelly green ("KG" specifying kelly green color).

Figure 4:
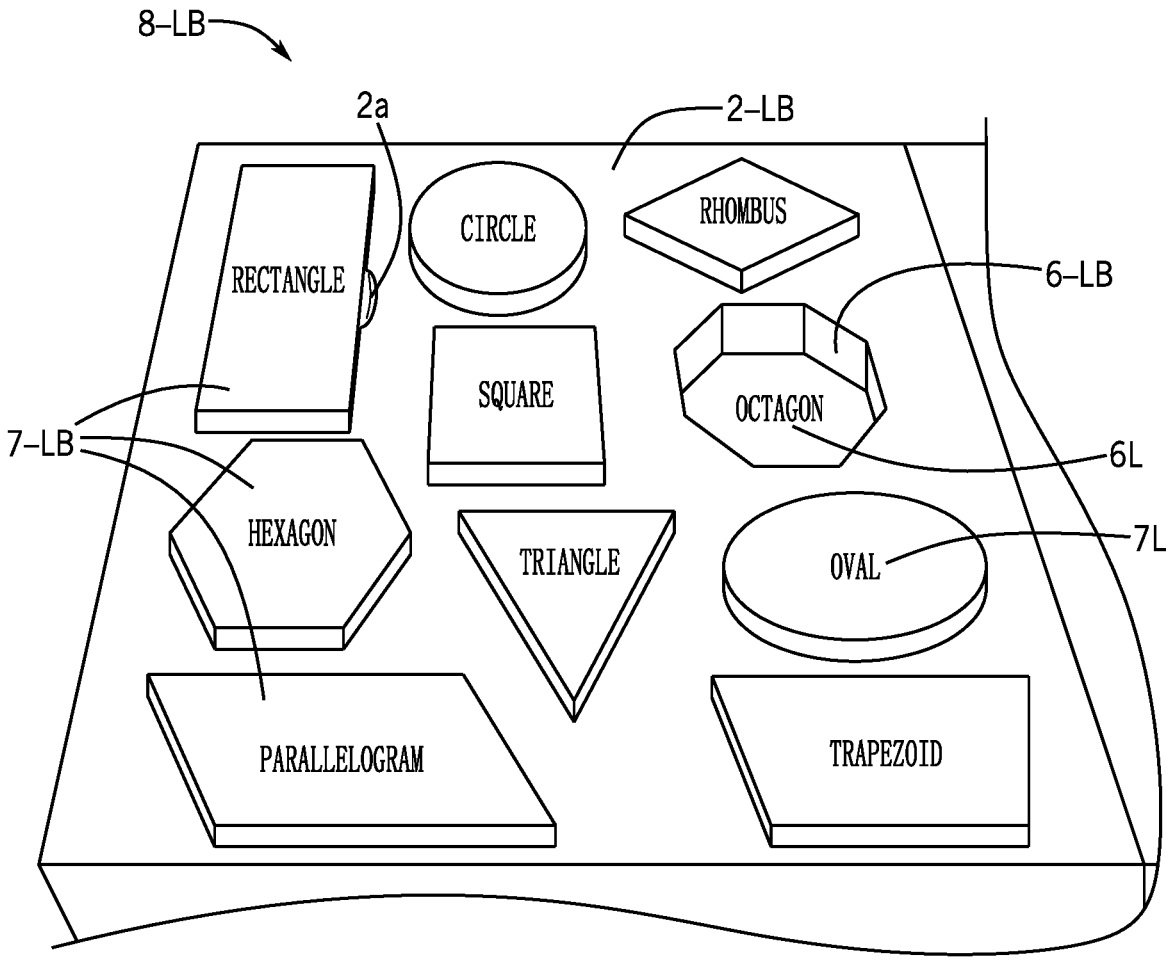
FIG. 4 is a front perspective view of one player zone of the first base station of FIG. 1.

In the Level I game, each one of the zones 8, 9, and 10, has a set of retrieval objects 7, 7 that is of the same color as the corresponding zone. For example, zone 8 shown in FIG. 1 and FIG. 4 has a matching subset of the plurality of retrieval objects 7, 7 all the members of that subset being colored to match the color of the zone 8. A retrieval object of the same color as the zone 8 is shaped and sized to fit into each one of the slots 6, 6 in that zone 8. For example, FIG. 1 shows a view of the top surface of zone 8 of base 1, having all but one of the plurality of retrieval objects 7, 7 inserted into the slots 6 of the zone 8. Each one of the zones includes slots 6 and retrieval objects matched in shape to the slots and matched in color to the zone, such as the light blue zone 8-LB including slots 6, 6 in the shapes of a rectangle, circle, rhombus, hexagon, square, octagon, triangle, oval, trapezoid, and parallelogram, with a light blue retrieval object 7-LB that matches each one of these slots in shape and color. Similarly, the bright blue zone for player 2, zone 9-BB, has matching retrieval objects 7-BB, and the kelly green zone for player 3, zone 10-KG, has matching retrieval objects -KG. FIG. 4 presents another view of a first one, zone 8-LB of the three zones that are shown in the base 1 of FIG. 1. As can be seen in FIGS. 1 and 4, each one of the zones 8, 9, and 10 has a set of ten retrieval objects matched to the color of that zone. Other embodiments may have a larger or smaller number of retrieval objects in each set.

Figure 5:
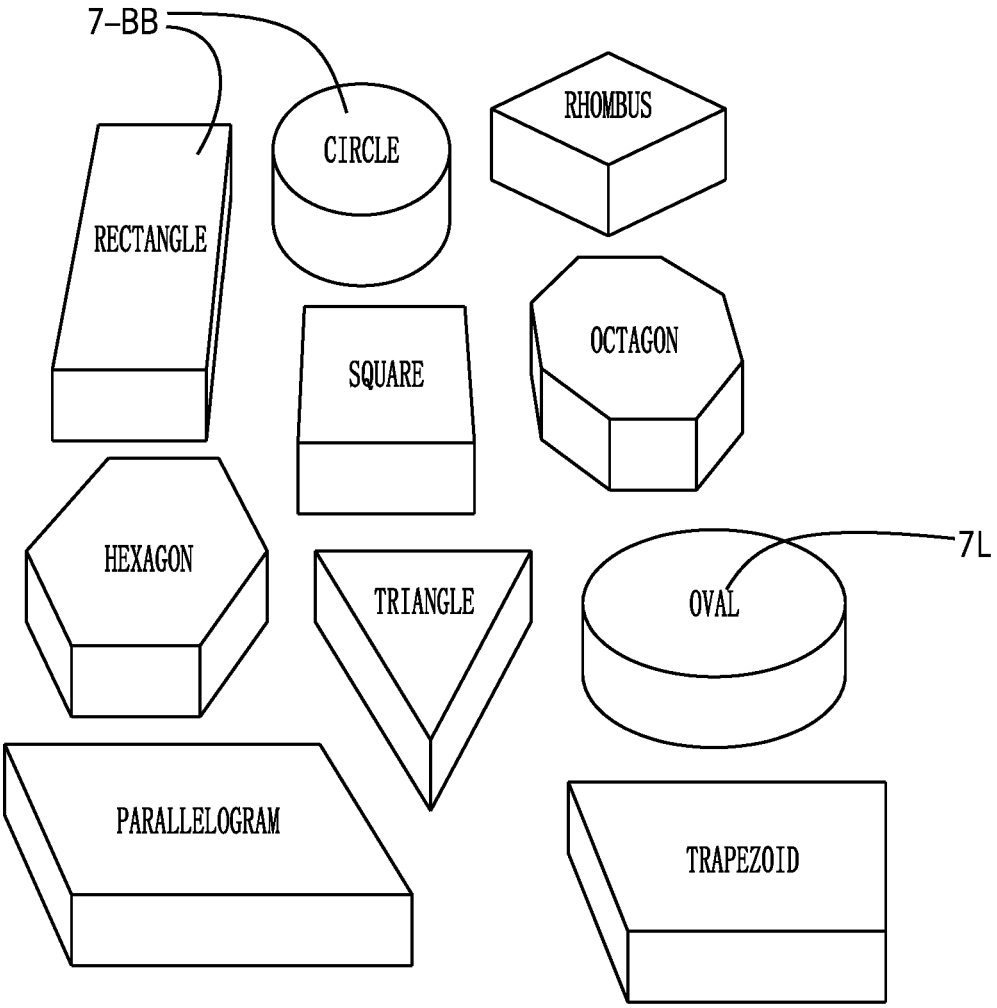
FIG. 5 is a perspective view of a set of retrieval objects for a first player for a Level I game according to the invention.

The retrieval objects 7, 7 preferably are formed of a thermoplastic material. A representative set of retrieval objects for one player in the Level I game is shown in FIG. 5. In the example shown in FIG. 5, there is depicted the objects 7-BB for the Player 2 zone 9-BB (shown in FIG. 1). For the Level I game, the objects 7, 7 are formed or made in a color that matches the color of the corresponding zone to which such objects are assigned. The retrieval objects may instead be painted to match the corresponding zone in color. The colors preferably are fluorescent or bright neon colors to help players see the game parts in low light conditions.

The retrieval objects 7, 7 are formed in a number of different geometric shapes, preferably as flat objects that are sized and shaped so as to be retrieved by players by hand from the bottom of the swimming pool. The thickness of a retrieval object is about three-quarters of an inch. The retrieval objects are adapted to sink in water. If the material of which the objects 7, 7 are formed is not sufficiently dense to drop to the floor of the pool P, the objects may comprise weights affixed to or embedded within the objects 7, 7, so that each object 7 is sufficiently dense to drop to the floor of the swimming pool P when tossed or otherwise distributed into the pool P. In an embodiment of the game, instead of being sufficiently dense to fall to the bottom of the pool P, the objects 7, 7 may be less dense than water, such that the objects float on the top surface of the water when tossed or otherwise distributed in the pool.

As seen in FIG. 5, for the Level I game, each one of the objects 7, 7 is labeled with a shape name label 7L on at least one, and preferably on both, of the two side surfaces of the object 7. The shape name label 7L displays in writing the geometric shape of that particular object 7. For example, as seen in FIG. 5, the shape name of "OVAL" is printed, embossed, or otherwise labeled onto the object 7 that is formed in the shape of an oval. The shape label 7L is labeled onto at least one of the two flat surfaces of the object 7. In this manner, players can read the shape names on the objects while playing the game. Preferably each slot 6 of each of the zones 8, 9, 10 is also labeled with the shape name label 6L of the geometric shape of that particular slot 6, as can be seen in empty slots 6, 6 that are depicted in FIGS. 1 and 4.

FIG. 4 shows a fingertip slot 2*a* that is in the form of a small indentation, aperture or depression that is formed in the top surface 2 of the base 1. The fingertip slot 2*a* is in a roughly semicircular shape and of a size to allow a user to insert a fingertip into the slot 2*a* to help grasp the edge of an object 7 that has been fitted into its slot 6, in order to lift it out of the slot 6 to prepare for the next play of the game.

Figure 6:
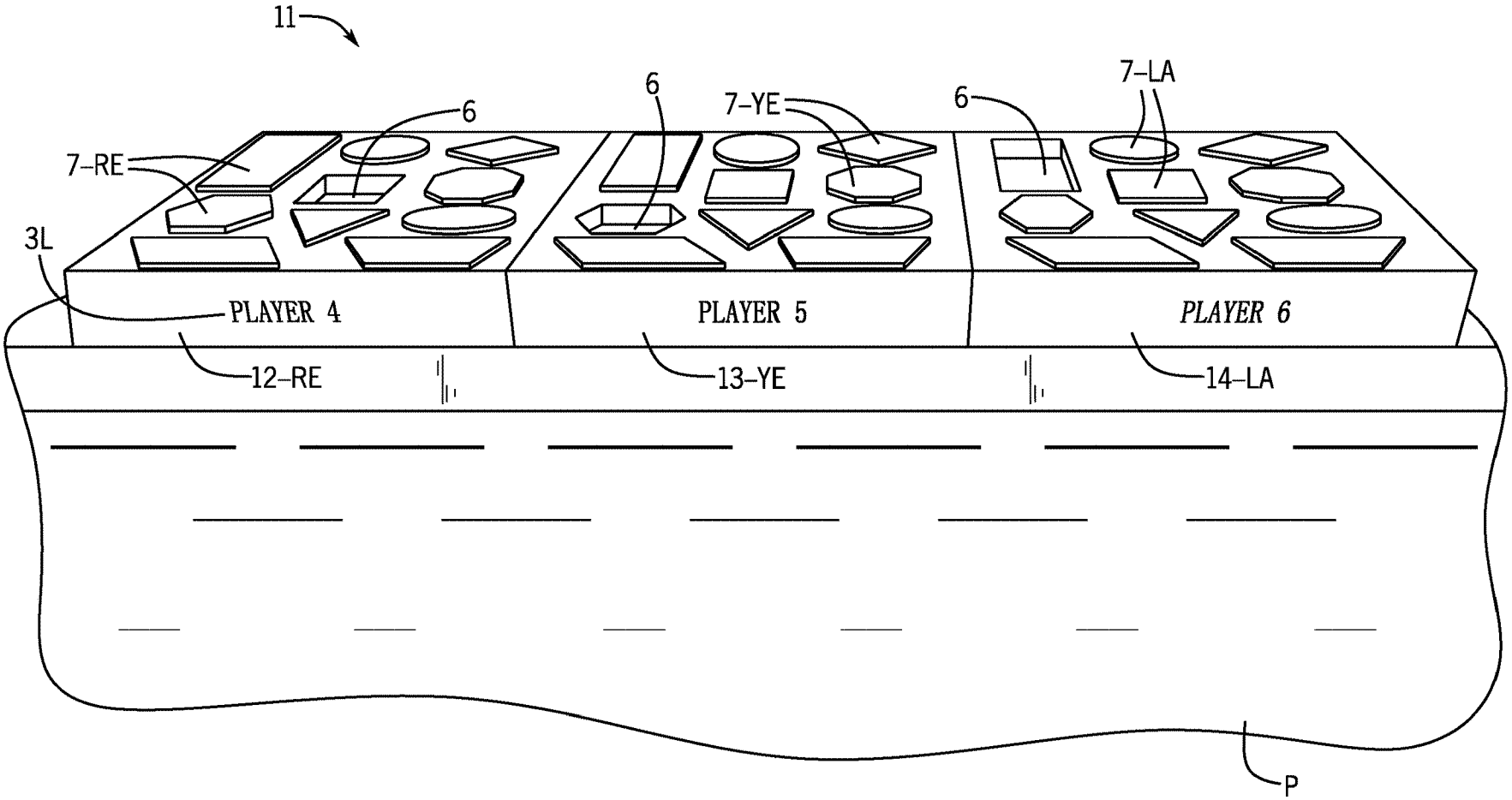
FIG. 6 is a front perspective view of a second base station of an embodiment of the invention.

The Level I game may be played by one or more players. In the example depicted in FIG. 1, the Level I game base 1 is adapted for play by up to three players, with each one of the three players assigned to a respective zone 8-LB, 9-BB, or 10-KG, with each zone having its respective matching retrieval objects matching its slots, as described above. In a preferred embodiment of the Level I game, at least one additional game base, a second base 11, is provided in addition to first base 1, so as to allow more players to play the Level I game. For example, FIG. 6 shows a representative example of a second game base 11 to be provided in addition to the first game base 1 shown in FIG. 1. As seen in FIG. 6, the second base 11 provides additional player zones. In this example, player zone 12 bears the player position marker in the form of a label 3L, for "Player 4" (red "RE" color zone), zone 13 with a label 3L indicating "Player 5" (yellow "YE" color zone), and zone 14 with a label 3L indicating "Player 6" (lavender "LA" color zone). The colors of the zones 12, 13, 14 of the second base 11 must differ from the colors of the zones 8, 9, 10 of the first base 1. As with the first base 1 shown in FIG. 1, each zone 12, 13, and 14 in second base 11 has its own respective matching colored and labeled retrieval objects (7-RE, 7-YE, and 7-LA respectively), similarly to those described above with regard to zones 8, 9, and 10.

FIG. 7 shows a chart listing a representative example of the full set of game pieces used to play the Level I game. FIG. 7 shows a list of all the game pieces used to play the six-player game employing the first base 1 of FIG. 1 as well as the second base 11 of FIG. 6, together with the objects matching the respective slots in the two bases 1, 11. There is provided for each one of the six player zones a set of matching objects in the same color as the respective zone, with each object matching the shape of one of the slots within that zone. For example, in the first base 1 of FIG. 1, Player 1 in the first zone 8 has ten retrieval objects 7, 7 all in different geometric shapes and all in a light blue (LB) color that matches the light blue color of zone 8. Each of Players 2 through 6 similarly has a set of ten retrieval objects 7, 7, all in different geometric shapes and all in the color that matches the player's respective zone color.

Method of Playing Level I Game.

The apparatus as described above for the Level I game is used in a method for playing a game as follows. The steps for game play are as follows. The base 1 (and optionally second base 11 to allow for additional players) are provided. The apparatus is prepared as follows. The bases 1, 11 are positioned by the side of a swimming pool P (shown in FIG. 1) or other suitable body of water in a position where all the players will be able to reach the top surface 2 of the base 1 in order to place retrieved objects 7, 7 into their respective assigned slots 6, 6. Each player is assigned to one of the respective zones 8, 9, 10, such that each player is accordingly assigned to retrieve all of the objects of the color matching the color of that assigned zone. All of the base subset of the plurality of retrieval objects 7, 7 are distributed into the water by one of the players or by a game master, and the objects 7, 7 sink to the bottom of the pool.

Playing of the game then commences. At a start signal to begin play, all of the players start from a designated start area, which might preferably be outside the pool P, or in the pool near the players' zones on the bases, according to the preferences of the players and the game master. At the start signal, each player swims toward the objects 7, 7 of that player's assigned zone color, retrieves the assigned objects (i.e., the objects that match the color of the player's assigned zone), and places the objects into the matching slot 6 in that player's assigned zone. The player is allowed to retrieve more than one of that player's assigned objects on each dive to retrieve objects 7, 7. No player is allowed to retrieve any other player's assigned objects 7, 7. In the nature of a race, the winner is the first player to successfully retrieve all of the player's objects 7, 7 of the player's assigned color, and to properly place the objects 7, 7 into the matching slots 6, 6 in that player's assigned zone. The game is finished when all of the players have completed the task of placing their respective objects 7, 7 into their corresponding slots 6, 6.

The Level I version of the game is primarily designed for players of lower ages and education levels, and having less developed swimming and diving skills, such as children aged four to six years of age. Thus, the Level I version of the game is preferably played in a shallower end of a swimming pool in cases where players have less developed swimming and diving skills. The base 1 is positioned on the side of the pool near the shallower end, and the objects are distributed in the pool nearer the shallower end, so that the tasks of swimming and diving to the bottom of the pool to retrieve the objects are easier for younger and smaller players. The Level I version of the game provides mental and physical educational benefits for younger players, such as learning to distinguish between and match colors, reading geometric shape names, developing gross motor skills in swimming and diving in a competitive race, and developing cognitive and fine motor skills in matching geometrically shaped objects 7, 7 into their matching slots 6, 6.

II. Level II Game.

The game apparatus may also preferably include additional equipment for playing games in addition to the Level I game described above. For clarity, the plurality of retrieval objects matched to the Level I base zones as described above may be referred to as the base group of the plurality of base retrieval objects, and the position markers of the base zones may be referred to as base position markers. This designation may distinguish those base portions of the apparatus from those of the Level II and Level III cover panel portions described below, which have cover zones, cover position markers, and cover groups of retrieval objects of the apparatus as more fully explained below.

Figure 8:
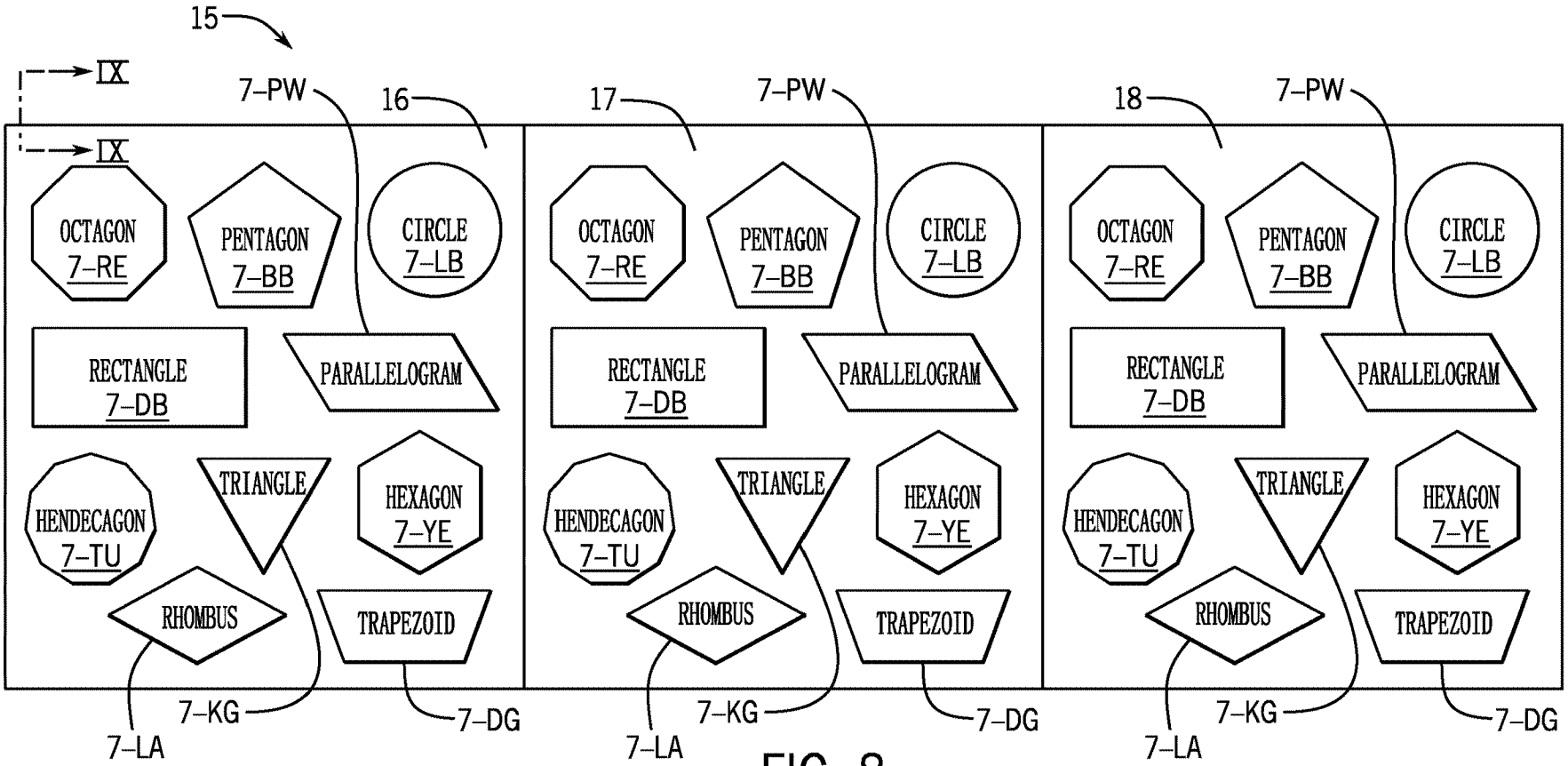
FIG. 8 is a top view of a Level II cover panel according to the invention.

FIG. 8 provides a representative example of apparatus for playing an additional game designated herein as the Level II game. In FIG. 8, there is shown a representation of a Level II cover panel 15 for playing a Level II version of the game.

The Level II cover panel 15 preferably is formed of a resilient but deformable thermoplastic material. The cover panel 15 is structured to be of a shape and size to be removably fitted to the base 1 to cover the top surface of the base 1.

Figure 9:
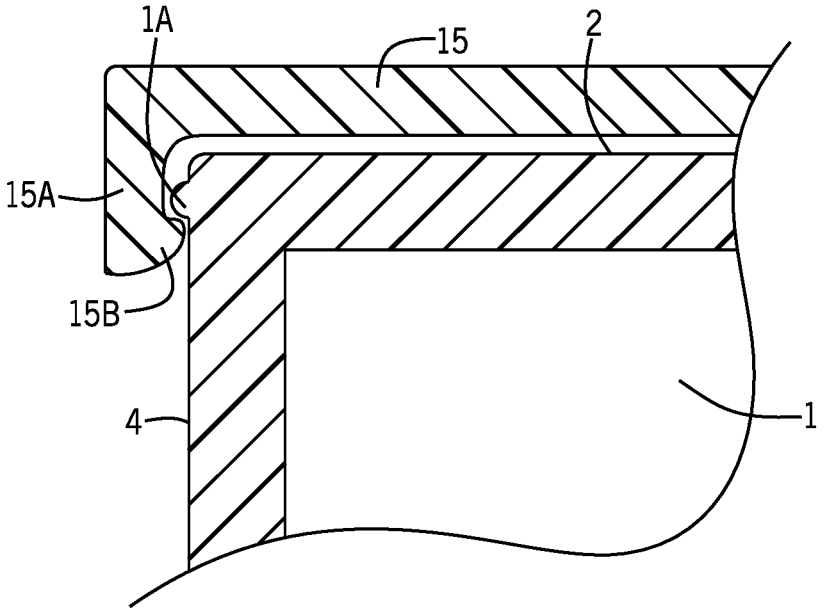
FIG. 9 is a partial cross-sectional view taken along line IX-IX of FIG. 8, showing a snap-latch feature for attaching the cover panel of FIG. 8 to a base station.

A feature for the removable affixation of the cover panel 15 to the base 1 is exemplified by a snap latch feature, such as one schematically depicted in cross-section in FIG. 9, taken along Line IX-IX of FIG. 8. As shown in FIG. 9, cover panel 15 includes a snap arm feature 15A that is resiliently flexible, disposed on one of the sides of the cover panel 15. The snap arm 15A is resiliently biased inwardly toward an inward side of the base when installed, and may be slightly deformed outwardly during pressing of the cover panel 15 by a user onto the top surface 2 of the base 1. The snap arm 15A is positioned and shaped to slide over a latch feature, which may preferably be formed as a lip 1A on a corresponding side (preferably the rear side 4) of the respective base 1 to which the cover panel 15 is to be removably affixed. As shown in the example in the cross-sectional view of FIG. 9, the snap arm 15A has been snapped into position after the user has installed cover panel 15 over the top surface 2 of base 1. A protrusion in the form of a ridge 15B formed on an inner side of the snap arm 15A that faces the body of the base 1 removably secures the panel 15 to the base 1 by abutting the corresponding lip 1A after the ridge 15B has slid downwardly over the lip 1A. The resiliently deformable snap arm 15A has snapped back inwardly after ridge 15B has slid over lip 1A as shown in FIG. 9. The snap arm 15A is sufficiently flexible to be adapted to be slightly pulled outwardly by the user when the user wishes to disengage the cover panel 15 from the base 1, such that the ridge 15B is pulled outwardly so as to no longer be engaged with the lip 1A. Other known means of removable affixation of the cover panel 15 to the base may be employed.

The cover panel 15 provided for playing the Level II version of the game comprises one zone for each player. The player number labels 3L shown in FIG. 1 on the base 1 are still visible on the front side 3 of the base 1 after affixation of the cover panel 15; the cover panel 15 does not conceal those player number labels 3L (e.g. "Player 1" player number marking for zone 8, "Player 2" player number marking for zone 9, etc.). These player number markings identify the assigned zones for each one of the players for the Level II game, as in the Level I game.

As seen in FIG. 8, each one of the zones 16, 17, 18 of cover panel 15 may have the same background color, unlike the zones of different colors employed in the Level I game version. The cover panel 15 has in each one of its zones 16, 17, 18 a plurality of slots 6, 6 having a geometric shape and size for receiving insertion of corresponding retrieval objects 7, 7. Each slot 6 on the Level II cover panel 15 is labeled with its respective geometric shape name 6L, similarly to the slots 6 in the Level I game base 1 as described above. Similarly to the Level I game, the cover panel 15 affixed to a first base 1 may preferably contain a separate zone 16, 17, 18 for each one of three players.

Additionally, a second Level II cover panel that is similar to the first Level II cover panel 15 may be affixed to a second base 11 in order provide additional zones for additional players. In the Level II game, the second Level II cover panel is identical in color and configuration to the first Level II cover panel 15.

In the Level II game, each zone in the cover panel 15 has slots matched, in geometric shape, to a set of retrieval objects 7, 7. Unlike in Level I, in Level II, each one of the retrieval objects 7 for a given player zone is a different color.

In Level II objects, the shape names are printed as shape name labels 7L onto the objects 7, 7 in the same manner as described above with respect to the Level I version. As seen in FIG. 8, each one of the player zones 16, 17, 18 in the cover panel 15 has an identical set of corresponding retrieval objects 7, 7 and slots 6, 6 sized and shaped to receive each of such objects. Thus, for example, as shown in an exemplary three-player cover panel 15 depicted in FIG. 8, there is one base 1, one cover panel 15 having three zones, and three sets of ten objects 7.

FIG. 10 shows a chart listing a representative example of the full set of game pieces used to play a six-player version of the Level II game. As shown in FIG. 10, the six-player Level II game may be played by employing the apparatus as follows: a first base 1 of FIG. 1 as well as the second base 11 of FIG. 6 are provided, with each one of these two bases fitted with a Level II cover panel 15 of the type shown in FIG. 8. There is provided, for each one of the six player zones in the Level II cover panels 15, 15, a set of objects. Each player zone's set of objects is identical to the set of objects of each other player zone. Each one of the objects matches both in shape and in color to one slot within a player zone. Thus, the full set of objects for the six-player game as described in FIG. 10 would include a total of sixty retrieval objects. As shown in the example of FIG. 8, each one of the six zones would have a set of objects that includes a red octagon (7-RE), a bright blue pentagon (7-BB), a light blue circle (7-LB), a dark blue rectangle (7-DB), a periwinkle parallelogram (7-PW), a turquoise hendecagon (7-TU), a kelly green triangle (7-KG), a yellow hexagon (7-YE), a lavender rhombus (7-LA), and a dark green trapezoid (7-DG).

In an embodiment of the Level II cover panel 15, the interior surface of each slot is painted or formed in a color that matches the color of the object in question. For example, the octagonally-shaped slot 6 of each player zone is colored red to match the red octagon object 7-RE that fits into the slot. In this manner, the Level II game differs from the Level I game, in that every player will be retrieving objects of different colors, whereas in Level I, each player retrieves objects of only one color. The apparatus must include additional retrieval objects for play of the Level II version as compared to Level I, because more than one shape in a given color is needed (e.g., for six players at the Level II game, six red octagons are required). Also, to increase the level of challenge for Level II players, more complex and unusual geometric shapes preferably may be used, such as a hendecagon 7-TU in Level II, as contrasted to an oval in Level I.

Method of Playing Level II Game.

A method for playing the Level II game employing this apparatus may be undertaken as follows. To set up a game for Level II play, the base 1 for up to three players is provided near the side of a pool P as for Level I play. Optionally, a second base 11 for additional players is also provided. Each base is fitted with a Level II cover panel 15 as shown in FIG. 8. The set of retrieval objects 7, 7 as summarized in FIG. 10 are all scattered in the body of water by a player or a game master. Each player is assigned a player zone by number (e.g., "Player 1" is assigned to zone 16 shown in the cover panel 15 of FIG. 8).

The game master gives a start signal to begin play of the game. At the start signal, each player starts from a designated start area, which might preferably be outside the pool, or in the pool near the player's assigned player zone on the cover panel 15 affixed to a base. The player leaves the start area to swim toward and collect the scattered retrieval objects 7, 7. The goal is for each player to collect the correct retrieval objects necessary to fill all the slots in the player's assigned zone with the matching objects of the matching shape and color. Thus, for example, if there are six players, there are six red octagon objects 7-RE, and any player can retrieve any one of those six red octagon objects 7-RE to fill that player's octagon-shaped slot in the player's assigned zone. The player is allowed to retrieve only one of that player's assigned objects at a time; a separate swim or dive must be made to retrieve each one of the player's objects.

No player is allowed to retrieve any other player's assigned object. If a player retrieves the wrong object (e.g., player 1 retrieves mistakenly retrieves an extra octagon after player 1 already has filled the octagon slot in player 1's assigned zone 16), then that player must place the wrongly-collected object into an opposing player's slot. The player that made the mistake must first attempt to place the wrongly-collected object into the opposing player's zone that is to the immediate right of the player who made the mistake (in this example, player 1 must place the octagon into the octagonal slot in player 2's zone 17). If the corresponding slot in the immediate-to-the-right zone is already filled, then the player who mistakenly retrieved the object must take the wrongly-retrieved object to the next following zone to the player's right for insertion into the matching-shaped slot (in this example, player 1 would find player 2's octagon slot in zone 17 already full, and so must put the octagon into the octagonal slot in player 3's zone 18), until the player finds an opponent's open slot that fits the shape of the object that had been retrieved by mistake. Thus, a player's mistake in retrieving the wrong object aids the player's opponent by filling in one of the opponent's slots. The Level II game is in the nature of a race where the winner is the first player to successfully retrieve and place all of the objects 7, 7 needed to fill all of the slots in the player's assigned zone. Thus, if player 1 is the first to fill all of the slots in her assigned zone 16, player 1 is the winner. The game is finished when all of the players have completed the task of filling all the slots 6, 6 in their respective assigned zones.

Level II play is aimed at children of ages of seven to twelve years, with educational and swimming/diving skills that are more highly developed than those of Level I players. Level II play is educational for this age group, as it teaches players reading skills in the nature of different names of geometrical shapes. The apparatus and method of Level II play encourages memory skills by rewarding a player for recalling during a swim which slots remain unfilled in the player's assigned zone, so that the player does not mistakenly retrieve a duplicate of a shape already retrieved. Level II play requires a number of separate swims and dives because each object must be retrieved separately, so faster swimming skills, and improved diving, breath-holding, and physical endurance may be developed by Level II play.

III. Level III Game.

In an embodiment of the game, the apparatus comprises equipment for playing a Level III version of the game. The Level III version of the game presents a higher challenge level than the Level I and II versions. In Level III play, during each dive, the player must retrieve the correct object that matches not only the shape, but also the color, of the particular slot in the player's assigned zone. This represents a higher level of challenge than Level II play, where, for example, all octagons are red, and so the Level II player is able to choose the correct object, even if the player remembers only the color and not the shape.

Figure 11:
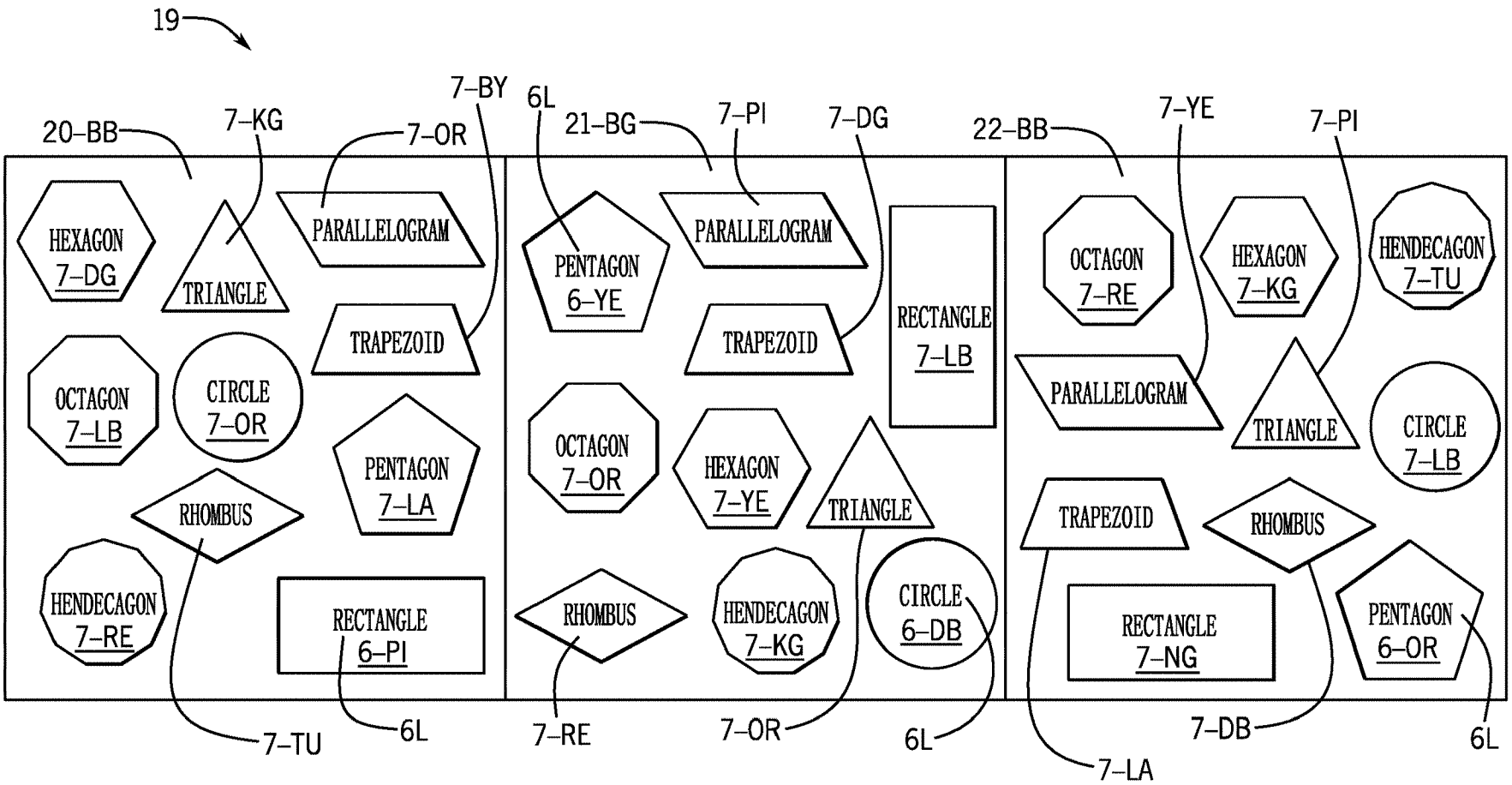
FIG. 11 is a top view of a first cover panel for a Level III game according to the invention.

In an example, a Level III game apparatus for three players includes a first Level III cover panel 19 as shown in FIG. 11. In the first Level III cover panel 19, each one of the slots within a given player zone is painted (or formed or otherwise colored) so that the recess of the slot has a different background color from all the other slots within that player zone. For example, open slot 6-PI has a pink background color different from the background colors of the other slots in that zone (the same difference applies for the open dark blue slot 6-DB in zone 21-BG and the open orange slot 6-OR in zone 22-BB).

The Level III game apparatus includes, for each one of the slots in the first Level III cover panel 19, a matching object having the same color and shape as the given slot. The recess color of a given-shaped slot is different in each one of the player zones, as shown in FIG. 11. Each slot 6 on the Level III cover panel 19 is labeled with its respective geometric shape name 6L, similarly to the slots 6 in the Level I game base 1 as described above.

In a representative example as shown in FIG. 11, the slots in the respective player zones of first Level III cover panel 19, and the corresponding retrieval objects 7, 7 that fit therein, have shape and coloring combinations as shown in the chart depicted in FIG. 12, which shows the list of game pieces for playing a three-player version of the Level III game. In the Level III cover panels, the color of the respective player zone outside of its recesses does not matter to the game play, other than marking the boundaries of the zones. It is thus preferable that adjoining zones have zone colors that differ from one another, to enable the players to distinguish the boundaries of the zones. Thus, in the example depicted in FIG. 11, the zones for players 1 and 3 (marked with reference numerals 20-BB and 22-BB, respectively) are bright blue in color, while the respective adjoining zone for player 2 (marked with reference numeral 21-BG) is bright green in color.

Other than the differing shape/color patterns above, the Level III cover panel 19 may otherwise preferably be structured similarly to the Level II cover panel 15, in that the Level III cover panel 19 also is preferably formed of a thermoplastic material, in a shape, size, and structure to be removably fitted to the bases 1, 11 to cover the top surface of the bases 1, 11. Features for removable affixation of the cover panel 19 to the base station 1 or 11 may be similar to those features described above with respect to affixation of Level II cover panel 15 to a base (see FIG. 9).

The Level III objects have, other than the differing color/shape combinations as described in FIG. 12 above, the same basic structure and composition as described above for the Level I and II objects set forth above. The shape name labels 7L are positioned on each of the flat sides of the objects 7, 7 provided for the Level III version of the game, similarly to the Level I and II objects 7, 7.

Figure 13:
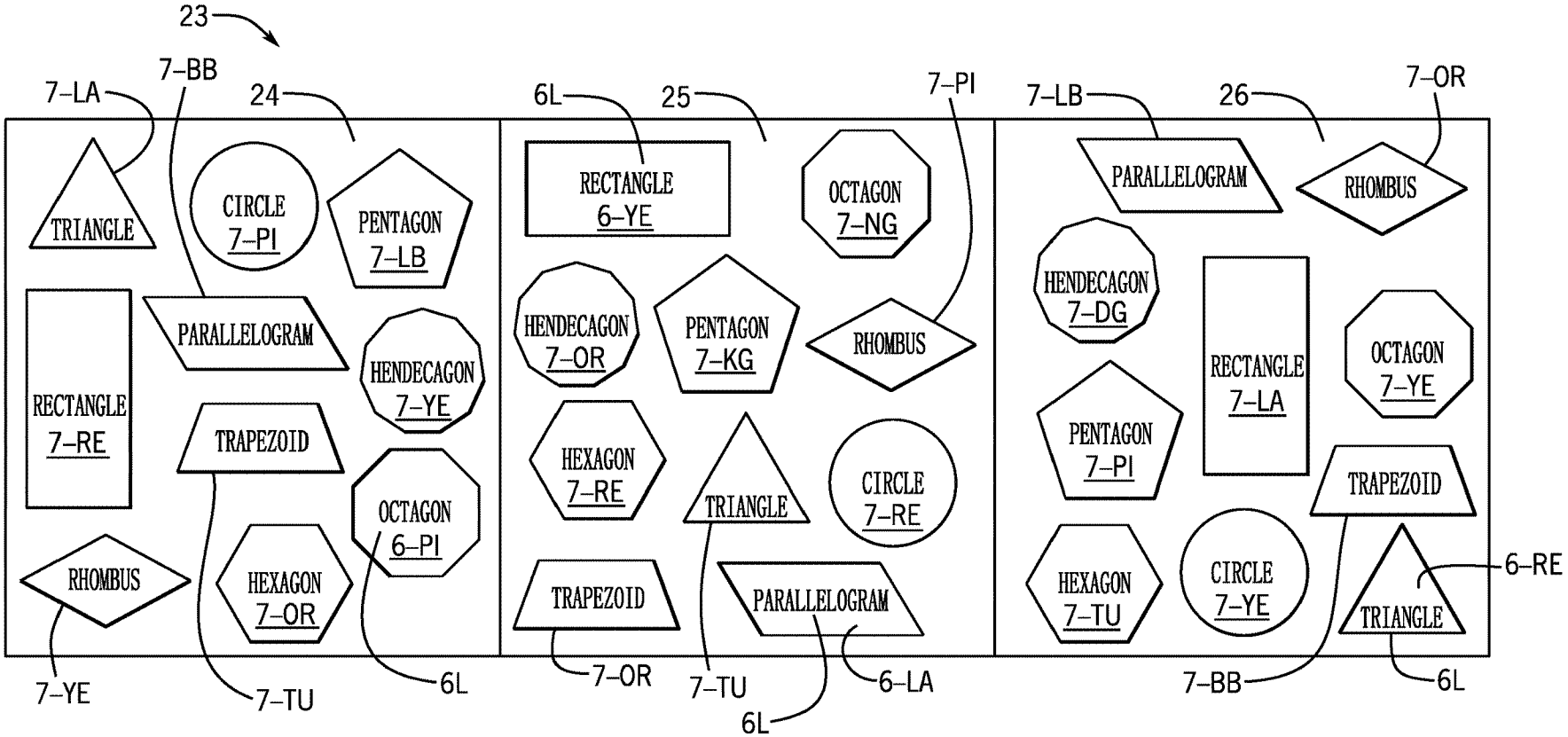
FIG. 13 is a top view of a second cover panel for a Level III game according to the invention.

Preferably, the Level III game apparatus may also include a second Level III cover panel 23 as shown in FIG. 13, so that up to six players may play the Level III game. The second Level III cover panel 23 as shown in FIG. 13 is affixed to a second base station 11. As may be seen in FIG. 13, player zones 24, 25, 26 are provided for three additional players. The player zone labels (3L) for Players 4, 5, and 6 positioned on the base station 11 are visible to players after affixation of the second Level III cover panel 23 to a second base station 11. The player zones for players four through six differ from those of players one through three, insofar as, in each zone, each one of the slots within a given player zone is painted (or formed or otherwise colored) so that the recess of the slot has a different background color from all the other slots within that player zone. The Level III game apparatus includes, for each one of the slots in the second Level III cover panel 23, a matching object having the same color and shape as the given slot.

In the six-player version of Level III game, the recess color of a given-shaped slot is different in each one of the six player zones. Thus, the apparatus includes objects matched to player zones four through six that have shape and color combinations as shown in FIG. 13 and presented in a list in FIG. 14. As may be appreciated from the game piece listings in FIGS. 12 and 14, each player is assigned to retrieve a unique set of objects 7, 7 having the particular shape and color combinations as listed in FIG. 14. Abbreviated color designations (e.g., "PI" for pink) are represented for the objects 7 in FIGS. 11 and 13, as listed in the charts of FIGS. 12 and 14. Examples of open slots having different background colors than the other slots of the respective zone are represented in FIG. 14 by the open octagon slot in a pink color (6-PI) in zone 24; the open parallelogram slot in a lavender color (6-LA) in zone 26; and the open triangle slot in a red color (6-RE) in zone 26.

The Level III cover panels 19, 23 each may preferably be removably affixed to a base 1. Alternatively, each Level III cover panel 19 or 23 may preferably be adapted to be removably affixed to a Level II cover panel 15. In this way, the Level II cover panel 15, may, in turn, be removably affixed to a base 1, in a stacked arrangement with the base on the bottom and the cover panels stacked together on top of the base. The removable affixation between a given cover panel and the cover panel or base below it may be accomplished by a snap latch feature like the one schematically depicted in FIG. 9 and described above with respect to the Level II cover panel 15.

Method of Playing Level III Game.

A Level III game using the apparatus described above may be set up for a method of playing a game as in the following example. The following example represents a Level III game for six players, but it is understood that a larger or smaller number of players may play. The first base 1 is fitted with a first Level III cover panel 19 as shown in FIG. 11, and the second base 11 is fitted with a second Level III cover panel 23 as shown in FIG. 13. The Level III retrieval objects, in the shape/color combinations as set forth in FIGS. 12 and 14, are all scattered in the body of water by a player or a game master. Each player is assigned a player zone by number (e.g., player number 1 is assigned to zone 20-BB of the first Level III cover panel 19 as shown in FIG. 11, etc.).

At a start signal for play of the Level III version of the game, each player starts from a designated start area, which might preferably be outside the pool, or in the pool near the player's assigned zone on the base station (see FIG. 1). The player dives or swims to collect the correct objects. The player is allowed to retrieve only one of that player's assigned objects at a time. A separate dive is made to retrieve each object. In Level III play, the player must choose the correct object that not only matches a shape of a slot in the player's zone, but also matches the color of that slot. For example, if the player's hexagon slot has a yellow-colored recess, that player may not fill that slot with a lavender-colored hexagon; the player must retrieve only the yellow hexagon to fill that slot.

The goal for each player is to fill each one of the slots in the player's assigned zone with the correct objects, with each object matching the color as well as the shape of the respective slot. In view of the particular shape and color combinations as set forth in the piece listings in FIGS. 12 and 14, only one object in the entire set of Level III objects will be the correct object to fit into a particular slot.

No player is allowed to retrieve any other player's assigned object. If a player retrieves the wrong object (e.g., player 1 assigned to zone 20-BB mistakenly retrieves the red rhombus object 7-RE that is assigned to player 2 playing in the 21-BG zone, instead of the correctly-colored turquoise rhombus object 7-TU), then that player must place that mistakenly-retrieved object into an opposing player's correct slot. In this regard, in Level III play, a player's mistake results in the player losing a great deal of time in the race, because the player who made the mistake must then take the additional time to find the correct opponent's slot that matches the particular color as well as shape of the mistakenly-retrieved object. Unlike Level II, the player who made the mistake in the Level III game does not merely put the object into the matching shaped slot of her neighboring opponent to the right. Instead, the player who made the mistake must find the correct slot matching both color and shape of the mistakenly-retrieved object. Also, a player's mistake in retrieving the wrong object aids the player's opponent by filling in one of the opponent's slots.

The game is in the nature of a race where the winner is the first player to successfully retrieve and place all of the correct objects 7, 7 to fill all of the slots in the player's assigned zone. The game is finished when all of the players have completed the task of placing the objects 7, 7 into their corresponding slots 6, 6 in all their assigned zones.

Level III play is aimed at older children of ages thirteen and over, and adults, with educational and swimming/diving skills that are more highly developed than those of Level I and Level II players. Level III play is educational for this age group, as it requires a player on each dive to exercise recall skills to remember both the particular color and the shape of the object that is needed to fill the open slot on the player's zone. The printed names of the shapes on the retrieval objects helps to improve the vocabulary skills of players, as they learn to recognize the printed names and associate them with the respective shapes. In particular, use of shape names rarely encountered in ordinary reading tasks, such as hendecagon, helps to expand players' vocabularies.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. For example, the particular shapes and colors depicted herein are merely examples, and the disclosure is not restricted to those particular shapes or colors. Any features that allow players to distinguish one zone from another, or one retrieval object from another, are contemplated as being within the scope of the invention. No restriction as to number or size of particular game parts is intended by depictions in the drawings or this written description, as the numbers and sizes have been selected to provide a representative example instead of a limiting description.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In view of economy and the other benefits arising from simplicity of design, the exclusion of elements is contemplated as within the scope of the invention herein, including elements described herein as well as those known in the field but not mentioned in this description.

In reading the claims, it is intended that when words such as "a," "an," "at least one," or are used there is no intention to limit the claim to only one item unless specifically stated to the contrary in the claim. Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. When an element or layer is referred to as being "on" another element or layer, it may be directly on, engaged, connected or coupled to the other element or layer, or intervening elements or layers may be present. As used herein, the term "and/or" includes any and all combinations of one or more of the associated listed items. Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments. The terms "comprises," "comprising," "including," and "having," are inclusive and therefore specify the presence of stated features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

LIST OF REFERENCE NUMERALS

P pool
1 base (first)
2 top surface of base 1
3 front surface of base 1
3L player zone label on front surface 3
4 rear surface of base 1
5 side surface of base 1
5*a* handle formed in side surface of base
6 slot (depression) in top surface of base
6L label on slot 6 (printed name of geometric shape of slot)
7 retrieval object
7L label on retrieval object 7 (printed name of geometric shape of retrieval object)
8 Player 1 zone in base 1
9 Player 2 zone in base 1
10 Player 3 zone in base 1
11 base (second)
12 Player 4 zone in base 11
13 Player 5 zone in base 11
14 Player 6 zone in base 11
15 Level II cover panel
15A snap arm of cover panel 15
15B ridge on inner side of snap arm 15A
1A lip of base to abut ridge 15B
16 Player 1 zone in cover panel 15
17 Player 2 zone in cover panel 15
18 Player 3 zone in cover panel 15
19 first Level III cover panel
20 Player 1 zone in first Level III cover panel 19
21 Player 2 zone in first Level III cover panel 19
22 Player 3 zone in first Level III cover panel 19
23 second Level III cover panel
24 Player 1 zone in second Level III cover panel 23
25 Player 2 zone in second Level III cover panel 23
26 Player 3 zone in second Level III cover panel 23

The invention claimed is:

1. A method for playing an educational swimming and diving race game in a body of water, comprising:

providing an apparatus for playing the game, the apparatus comprising:
a box-shaped base configured to abut an edge of a body of water; and
a plurality of retrieval objects, each retrieval object adapted to sink in water,
wherein the base is divided into at least two defined base player zones formed in an upper surface of the base, with each base player zone configured to be assigned to a player,
each one of the base player zones is a different color,
each one of the base player zones comprises a plurality of position markers, each base position marker being a recess formed in the upper surface of the base and structured to receive insertion of retrieval objects having the same geometric shape as the base recess,
each one of the base recesses within each base player zone has a different geometric shape,
a base group of the plurality of retrieval objects comprises base subsets of the plurality of retrieval objects,
each one of the base subsets is matched to each base player zone by having a same color as the base player zone matched to the subset, and each one of the retrieval objects in each subset has a geometric shape matched to a geometric shape of one of the base recesses of the base player zone matched to that subset;

preparing for play of the game by positioning the base by the edge of the body of water in a position where players will reach the base, assigning each one of the players to a respective one of the base player zones, and distributing the retrieval objects in the body of water; and playing of the game, wherein playing of the game comprises
each player retrieving retrieval objects that match base recesses of the player's assigned base player zone and placing each one of the retrieved retrieval objects in the matched base recess, and
establishing a winner of the game as a first one of the players to complete the placing of retrieved retrieval objects into all of the matched base recesses of the player's assigned base player zone.

2. The method according to claim 1, wherein the upper surface of the base is positioned at an angle of 90 degrees or less relative to a bottom plane of the base.

3. The method according to claim 1, wherein at least one of the base recesses or first cover recesses is marked with a name of a respective geometric shape of the base recess or first cover recess.

4. The method according to claim 1, wherein at least one of the retrieval objects is marked with a name of a respective geometric shape of the retrieval object.

5. The method according to claim 1, wherein at least one of the base player zones is marked with a player number.

* * * * *